United States Patent [19]
Osuga et al.
[11] 4,417,558
[45] Nov. 29, 1983

[54] FUEL FEEDING APPARATUS FOR INTERNAL COMBUSTION ENGINE

[75] Inventors: Minoru Osuga, Hitachi; Yoshishige Oyama, Katsuta; Mamoru Fujida, Ibaraki, all of Japan

[73] Assignee: Hitachi, Ltd., Tokyo, Japan

[21] Appl. No.: 359,512

[22] Filed: Mar. 18, 1982

[30] Foreign Application Priority Data

Mar. 25, 1981 [JP] Japan ..... 56-40821[U]

[51] Int. Cl.³ ..... F02D 5/00

[52] U.S. Cl. ..... 123/489; 123/440; 123/482; 123/494

[58] Field of Search ..... 123/438, 440, 482, 489, 123/494, 589

[56] References Cited

U.S. PATENT DOCUMENTS

| | | | |
|---|---|---|---|
| 3,776,208 | 12/1973 | Stumpp | 123/494 |
| 4,043,300 | 8/1977 | Lombard | 123/482 |
| 4,145,999 | 3/1979 | Aoki | 123/489 |
| 4,217,314 | 8/1980 | Dysarz | 123/438 |
| 4,264,961 | 4/1981 | Nishimura et al. | 123/494 |
| 4,364,354 | 12/1982 | Kosuge et al. | 123/438 |

*Primary Examiner*—Charles J. Myhre
*Assistant Examiner*—Andrew M. Dolinar
*Attorney, Agent, or Firm*—Antonelli, Terry & Wands

[57] ABSTRACT

A fuel feeding apparatus for an internal combustion engine, in which a thermal type flow sensor is disposed in a bypass air path supplying bypass air from a point upstream of a Venturi portion formed in a main air-intake path to the Venturi portion, and the quantity of air flowing through the bypass air path is controlled by a solenoid unit so that the output signal of the thermal type flow sensor attains coincidence with a pre-set level. A fuel-metering valve actuated by the solenoid unit meters the quantity of fuel meeting a variation of the quantity of intake air being supplied to the engine so as to inject the metered quantity of fuel in a continuous flow into the main air-intake path. An oxygen sensor senses the concentration of oxygen in engine exhaust gases, and, on the basis of the output signal of the oxygen sensor, the value of the pre-set level is modified so that the rate of excess air in engine exhaust gases can be maintained to be $\lambda=1$.

11 Claims, 5 Drawing Figures

FUEL FEEDING APPARATUS FOR INTERNAL COMBUSTION ENGINE

This invention relates to apparatus for feeding fuel to an internal combustion engine, and more particularly to such an apparatus of the electronic type suitable for determining, under closed-loop control, the quantity of fuel most suitable from the aspect of purification of engine exhaust gases.

In a known fuel feeding apparatus of the electronic type for feeding fuel to an internal combustion engine by measuring the flow rate of intake air flowing through the air-intake path and determining the most suitable quantity of fuel to be mixed with the measured quantity of intake air, the concentration of oxygen contained in engine exhaust gases is sensed, and, on the basis of the signal indicative of the sensed oxygen concentration, an injector meters and feeds the quantity of fuel which provides the optimum stoichiometric air-fuel ratio of the air-fuel mixture supplied to the engine. However, such a system has had defects including difficulty of closed-loop control with high accuracy resulting in poor controllability and delayed control of the system.

In another fuel feeding apparatus of the type intermittently injecting fuel by an injector, a high delivery pressure is required for the fuel pump feeding fuel under pressure so as to enhance the control response characteristic, resulting in an increased electrical load. Further, fuel intermittently injected by the injector is not satisfactorily atomized as compared with the degree of atomization by the carburetor. Therefore, various contrivances accompanied by design difficulties have been required for improving the degree of atomization of fuel intermittently injected by the injector.

A patent application filed by the assignee of the present application prior to the application date of the present application discloses a fuel feeding apparatus in which, in order to maintain the air-fuel ratio always at the stoichiometric value of about 14.7, the quantity of fuel is so controlled in relation to the quantity of intake air that the flow rate of air flowing through a bypass air path disposed adjacent to a main air-intake path can be maintained always constant. The disclosed fuel feeding apparatus comprises a first valve for regulating the flow rate of air flowing the flow rate of air flowing through the bypass air path disposed adjacent to the main air-intake path and a second valve for regulating the quantity of fuel flowing through a fuel path to be injected into the main air-intake path. In the apparatus, the first and second valves are actuated in interlocking relation, so that air of regulated or constant flow rate (corresponding to the stoichiometric air-fuel ratio) can always flow through the bypass air path thereby maintaining the air-fuel ratio at the predetermined value which is the stoichiometric air-fuel ratio. Such an apparatus is advantageous over the prior art apparatus in that the interlocking operation of the two valves regulating the quantities of air and fuel respectively ensures the desired satisfactory control response, and the continuous flow of the air-fuel mixture similar to that provided by the conventional Venturi type carburetor ensures the desired satisfactory atomization of fuel. Such an apparatus is also advantageous in that the accuracy of control can be maintained or ensured even when the operating characteristic of the air flow meter measuring the flow rate of air flowing through the bypass air path is such that the air flow meter generates a non-linear output.

However, the proposed apparatus has had a few drawbacks although it exhibits the above noted marked advantages. One of the drawbacks is that accumulation of dust or like foreign matters on the sensor of the air flow meter gives rise to appearance of an erroneous output from the air flow meter, and the desired accurate control will not be achieved. The second drawback is that the two valves, especially, the second valve controlling the quantity of fuel must be fabricated to be highly precise in dimensions, and, therefore, a fabrication error of this second valve will exert a serious influence on the accuracy of the air-fuel ratio control.

With a view toward obviating the drawbacks pointed out above, it is a primary object of the present invention to provide an improved fuel feeding apparatus for an internal combustion engine, in which an oxygen sensor, hereinafter referred to as an $O_2$ sensor, sensing the concentration of oxygen contained in engine exhaust gases is disposed in the exhaust gas path of the engine so as to check, on the basis of the output of the $O_2$ sensor, as to whether or not the predetermined regulated flow rate of air flowing through the bypass air path is suitable for providing the stoichiometric air-fuel ratio, and, when the result of check proves that the flow rate is not suitable, the predetermined value of the quantity of bypass air (the level setting) is suitably modified to attain the stoichiometric air-fuel ratio.

The apparatus according to the present invention is featured by the fact that, when a change occurs in the quantity of intake air, the cross-sectional area of the bypass air path having the air flow meter disposed therein is changed correspondingly so as not to change or so as to maintain constant the output signal level of the air flow meter, the cross-sectional area of the fuel path being also changed in interlocking relation with the change in the cross-sectional area of the bypass air path so as to regulate the quantity of fuel, and whether or not the proper quantity of air is flowing through the bypass air path is checked on the basis of the output signal level of the $O_2$ sensor so as to change or modify the output signal level of the air flow meter depending on the result of check.

The apparatus according to the present invention provides the same advantages as those provided by the assignee's earlier application cited hereinbefore and yet obviates the drawbacks of the earlier application pointed out hereinbefore.

The present invention will now be described in detail with reference the accompanying drawings, in which.

Figure 1:
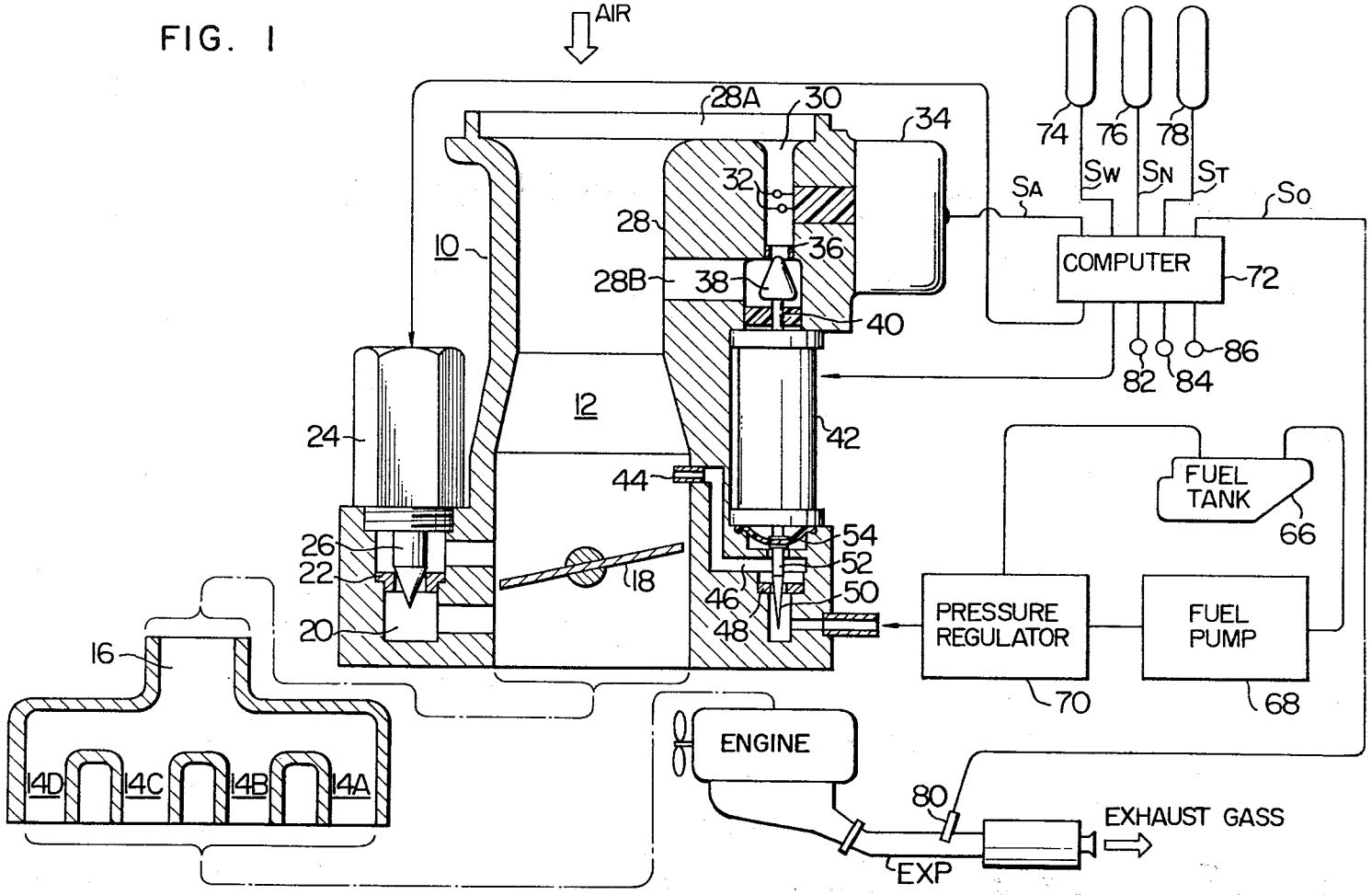
FIG. 1 is a diagrammatic view showing the construction of a preferred embodiment of the fuel feeding apparatus for an internal combustion engine according to the present invention.

Referring to FIG. 1, reference numeral 10 generally designates a main body in which a main path 12 of intake air is formed. This main air-intake path 12 is connected to a manifold portion 16 of intake pipes 14A, 14B, 14C and 14D communicating with the respective cylinders of, for example, a 4-cylinder internal combustion engine. A throttle valve 18 is rotatably disposed within the main air-intake path 12 formed in the main body 10 and is actuated by depression of the accelerator pedal (not shown). The throttle valve 18 is bypassed by a path 20 of compensation air which extends through the main body 10 from a point upstream of the throttle valve 18 to a point downstream of the throttle valve 18, and an orifice 22 is provided midway of this compensation air path 20. This orifice 22 constitutes a metering part together with a valve member 26 actuated by an electromagnetic unit 24. A Venturi 28 is formed in the portion of the main air-intake path 12 upstream of the throttle valve 18, and the inlet portion 28A and the narrowest portion 28B of this Venturi 28 are connected by a path 30 of bypass air formed in the main body 10. A thermal type flow sensor 32 such as a hot-wire sensor, a hot-film sensor or a Thomas meter is disposed midway of this bypass air path 30, and the output signal from this thermal type flow sensor 32 is applied to and processed by a signal processing circuit 34 which is fixedly mounted on the main body 10. An air-metering orifice 36 is provided in the bypass air path 30 at a position downstream of the thermal type flow sensor 32 to constitute an air-metering part by cooperation with an air-metering valve 38 of tapered configuration. This air-metering valve 38 is connected to a proportional electromagnetic or solenoid unit 42 through an output shaft or piston 40.

A fuel injection port or main nozzle 44 opens in the main air-intake path 12 at a position intermediate between the throttle valve 18 and the Venturi 28 and communicates with a path 46 of fuel formed in the main body 10. A fuel-metering orifice 48 is provided midway of the fuel path 46 to constitute a fuel-metering part by cooperation with a fuel-metering valve 50 of tapered configuration. The fuel-metering valve 50 is connected to the proportional solenoid unit 42 through an output shaft or piston 52. The output shaft or piston 52 and the associated portion of the main body 10 are partitioned by a bellows type diaphragm 54 so that fuel flowing through the fuel path 46 may not leak to the exterior of the main body 10.

Figure 2:
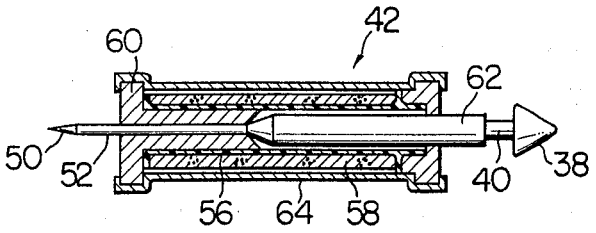
FIG. 2 is an axial sectional view of the proportional electromagnetic unit shown in FIG. 1.

The air-metering valve 38, fuel-metering valve 50 and proportional solenoid unit 42 are constructed or arranged as shown in FIG. 2. Referring to FIG. 2, the proportional solenoid unit 42 includes a coil 58 wound around a hollow bobbin 56, a stationary core 60 inserted and fixed in the hollow space of the bobbin 56, a movable core 62 slidably disposed in the hollow space of the bobbin 56, and a casing 64. The output shaft or piston 40 is fixed to one end of the movable core 62, and the output shaft or piston 52 is fixed to the other end of the movable core 62. Therefore, the air-metering valve 38, fuel-metering valve 50 and movable core 62 are axially aligned on the same axis, and the air-metering valve 38 and fuel-metering valve 50 are simultaneously driven by movement of the movable core 62.

Fuel contained in a fuel tank 66 is pumped out by a fuel pump 68, and fuel under pressure discharged from the fuel pump 68 is fed to the fuel path 46 after pressure regulation by a pressure regulator 70. The pressure regulator 70 and fuel pump 68 are of known construction, and the pressure regulator 70 is designed to provide a regulated fuel pressure of, for example, 0.7 $kg/cm^2$.

Signal inputs to and signal outputs from a computer 72 shown in FIG. 1 will now be described.

Signals applied to the computer 72 include the output signal $S_A$ from the thermal type flow sensor 32 (which signal is equivalent to the output signal from the signal processing circuit 34), the output signal $S_W$ from a water temperature sensor 74 sensing the temperature of engine cooling water, the output signal $S_N$ from a rotation speed sensor 76 sensing the rotation speed or the number of revolutions of the engine, the output signal $S_T$ from a known, throttle valve opening sensor 78 sensing the opening of the throttle valve 18, and the output signal $S_o$ from an $O_2$ sensor 80 disposed in the exhaust pipe EXP. Signals indicative of other engine operation parameters may, of course, be applied to the computer 72 for the purpose of correction of various factors when so required.

Output signals from the computer 72 are applied to the electromagnetic or solenoid unit 24, to the proportional solenoid unit 42, to an EGR (exhaust gas recirculation) control unit 82, to an ignition timing control unit 84 and to a control unit 86 controlling the fuel pump 68.

The operation of the solenoid unit 24 will not be described herein as they have no direct concern with the present invention.

Figure 3:
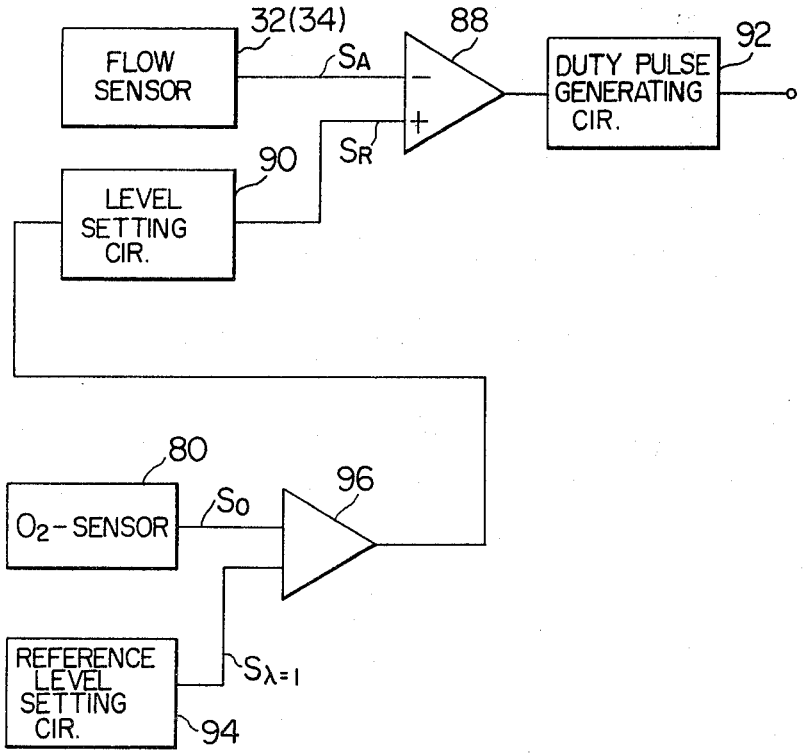
FIG. 3 is a block diagram of a circuit including the thermal type flow sensor and $O_2$ sensor shown in FIG. 1 for generating a control signal controlling the proportional electromagnetic unit shown in FIG. 1.

The signal applied to the proportional solenoid unit 42 from the computer 72 is a duty pulse signal having a controlled on-duration per period, and such a duty pulse signal is produced by a circuit having a structure as shown in FIG. 3. Referring to FIG. 3, the output signal $S_A$ from the thermal type flow sensor 32, hence, the signal processing circuit 34, is applied to the inverted input terminal of a comparator 88, and a level signal $S_R$ from a level setting circuit 90 is applied to the non-inverted input terminal of the comparator 88. The output signal indicative of the result of comparison in the comparator 88 is applied to a succeeding duty pulse generating circuit 92 to be converted into a duty pulse signal which is applied to the proportional solenoid unit 42.

When the level of the output signal $S_R$ of the level setting circuit 90 is selected to correspond to the predetermined stoichiometric air-fuel ratio (AF=14.7), the air-fuel ratio is so controlled as to be maintained at the predetermined stoichiometric value, as will be described in detail later with reference to a flow chart. However, in the presence of secular variations attributable to accumulation of particles of dust and other foreign matters on the flow sensor 32 or in the presence of a fabrication error of the valve 50, as pointed out hereinbefore, the air-fuel ratio will not actually be maintained at the stoichiometric value and will be maintained at a value different from the stoichiometric value even when the output signal $S_R$ of the level setting circuit 90 is set at the level corresponding to the stoichiometric air-fuel ratio. In order to obviate such a discrepancy, the present invention utilizes the output signal $S_o$ from the $O_2$ sensor 80 for checking whether or not the air-fuel ratio is maintained at the stoichiometric value, that is, checking whether or not the value of $\lambda$ in the engine exhaust gases is equal to unity, and, when the result of check proves that there is an error between the actual air-fuel ratio and the stoichiometric air-fuel ratio, the setting of the level setting circuit 90 is changed or modified by the amount corresponding to the error.

For this purpose, a reference level setting circuit 94 providing an output signal $S_{\lambda=1}$ indicative of a pre-set reference level is connected to a comparator 96 together with the $O_2$ sensor 80. In the comparator 96, the output signal $S_o$ of the $O_2$ sensor 80 is compared with the output signal $S_{\lambda=1}$ of the reference level setting circuit 94, and the output signal indicative of the result of comparison is applied to the level setting circuit 90 to suitably modify the setting of the level setting circuit 90.

The quantity of air flowing through the bypass air path 30 during operation of the engine and metered by the air-metering part composed of the air-metering valve 38 and orifice 36 is maintained constant under control of the proportional solenoid unit 42 regardless of the quantity of air flowing through the main air-intake path 12. The sectional area of the orifice 48 constituting the fuel-metering part together with the fuel-metering valve 50 is also changed under control of the proportional solenoid unit 42 to meter the quantity of fuel to be fed to the main nozzle 44 through the fuel path 46.

There are the following relationships among the sectional area A of the main air-intake path 12, the quantity $Q_a$ of air flowing through the main air-intake path 12, the sectional area a of the bypass air path 30, the quantity q of air flowing through the bypass air path 30, and the pressure difference $\Delta P$ across the Venturi 28:

$$Q_a = k_1 \cdot A \cdot \sqrt{\Delta P} \quad (1)$$

$$q = k_2 \cdot a \cdot \sqrt{\Delta P} \quad (2)$$

where $k_1$ and $k_2$ are constants. Hence, there holds the following relationship:

$$Q_a/q = A/a \quad (3)$$

Suppose, for example, that the opening of the throttle valve 18 is now increased to increase the quantity $Q_a$ of air flowing through the main air-intake path 12. This is naturally followed by the corresponding increase in the quantity q of air flowing through the bypass air path 30. According to the embodiment of the apparatus of the present invention, the piston 40 of the proportional solenoid unit 42 is moved in a direction in which the sectional area a of the bypass air path 30 in the relationship (3) is decreased so as to maintain constant the quantity q of bypass air. In other words, the piston 40 is urged upward in FIG. 1. Consequently, the fuel-metering valve 50 is also urged upward in FIG. 1 to define a wider space between it and the orifice 48, so that an increased quantity of fuel can now flow through the fuel path 46. In this manner, the quantity $Q_f$ of fuel can be increased to deal with the increase in the quantity $Q_a$ of intake air.

On the other hand, when the opening of the throttle valve 18 is decreased to decrease the quantity $Q_a$ of intake air, the piston 40 is urged downward in FIG. 1 to increase the sectional area a of the bypass air path 30, and the space defined between the orifice 48 and the fuel-metering valve 50 is correspondingly narrowed to decrease the quantity $Q_f$ of fuel fed to the main nozzle 44.

In the present invention, whether or not the quantity $Q_a$ of intake air is optimum is checked continuously on the basis of the output signal $S_o$ of the $O_2$ sensor 80.

The manner of control of the quantity $Q_f$ of fuel will now be described in detail with reference to a flow chart of FIG. 4.

In steps 401 and 402, the output signal $S_A$ of the thermal type flow meter 34 and the output signal $S_R$ of the level setting circuit 90 are fetched respectively, and such signals are applied to the inverted and non-inverted input terminals of the comparator 88 respectively. In step 403, the signals $S_A$ and $S_R$ are compared with each other, and, when the result of comparison proves that $S_A < S_R$, the duty factor of the duty pulse signal generated from the circuit 92 is increased in step 404. On the other hand, when the result of comparison in step 403 proves that $S_A > S_R$, the duty factor of the duty pulse signal is decreased in step 405. In step 406, the proportional solenoid unit 42 is energized by the duty pulse signal whose duty factor is increased in step 404 or decreased in step 405. When the result of comparison in step 403 proves that $S_A = S_R$, the piston 40 of the solenoid unit 42 is not urged in either direction, and the existing duty factory is maintained in the duty pulse signal. In the manner above described, the quantity $Q_a$ of air flowing through the bypass air path 30 is controlled by the air-metering valve 38 so as to maintain equality between the level of the signal $S_A$ and the preset level $S_R$. This manner of control is called herein "closed-loop control CL1 in response to the output $S_A$ of the thermal type flow meter 34." This closed-loop control CL1 is composed of steps

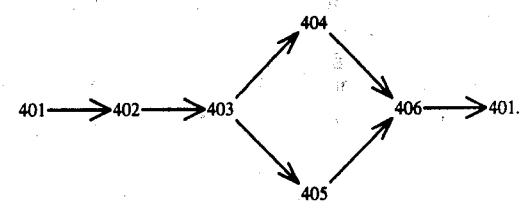

It will thus be seen that the air-fuel ratio can be maintained at the value corresponding to the predetermined level $S_R$ by the closed-loop control CL1 done in quick response to the output $S_A$ of the thermal type flow meter 34.

In step 407, the engine system operates, and, in step 408, the output signal $S_o$ of the $O_2$ sensor 80 disposed in the exhaust gas pipe EXP is fetched. In step 409, the output signal $S_o$ of the $O_2$ sensor 80 is compared in the comparator 96 with the output signal $S_{\lambda=1}$ of the reference level setting circuit 94. The rate $\lambda$ of excess air in the engine exhaust gases is represented by $$\frac{\text{the actual air-fuel ratio}}{\text{the stoichiometric air-fuel ratio}},$$

and the signal $S_{\lambda=1}$ is set at the level corresponding to $\lambda=1$. Therefore, the output signal $S_{\lambda=1}$ of the reference level setting circuit 94 has a voltage level corresponding to $\lambda=1$. When the result of comparison in step 409 proves that $\lambda>1$, a compensating value x is added in step 410 to the output signal $S_R$ of the level setting circuit 90. This means that the quantity $Q_f$ of fuel is to be increased. On the other hand, when the result of comparison in step 409 proves that $\lambda \leqq 1$, a compensating value x is subtracted in step 411 from the signal $S_R$. The signal $S_R'$ obtained as a result of the addition in step 410 or subtraction in step 411 is set in step 412 in the circuit 90 as a new signal $(S_R)_{NEW}$.

In the manner above described, the setting of the level setting circuit 90 is controlled so that the value of in the engine exhaust gases can be maintained at $\lambda=1$. The closed-loop control CL2 in response to the output signal $S_o$ of the $O_2$ sensor 80 is thus composed of steps

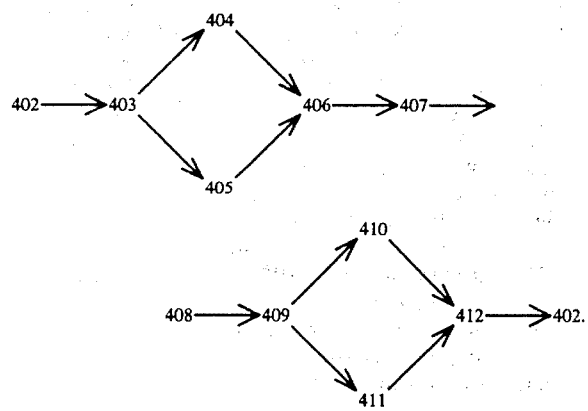

According to the air-fuel ratio control described with reference to FIG. 4, the air-fuel ratio is controlled to be maintained at the predetermined value $S_R$ under the closed-loop control CL1 which is continuously done, and, even if the output signal $S_A$ of the thermal type flow meter 34 tends to vary due to accumulation of dust or like foreign matters on the sensor 32 in the course of the continuous closed-loop control CL1, the setting of the level setting circuit 90 is suitably modified under the closed-loop control CL2 which is intermittently done, so that the value of $\lambda$ can be maintained at $\lambda=1$ if the value of $\lambda$ in the engine exhaust gases is detected to deviate from $\lambda=1$. Therefore, the air-fuel ratio can be controlled with high accuracy to be maintained at the stoichiometric air-fuel ratio, and, as a result of the highly accurate air-fuel ratio control, the desired purification of engine exhaust gases can be achieved with high reliability.

Although a single solenoid unit 42 is employed in the above-described embodiment of the present invention, this single solenoid unit 42 may be replaced by two solenoid units which are connected to the valves 38 and 50 respectively so that the two valves 38 and 50 can be simultaneously urged in the same direction by the two solenoid units respectively.

The signal processing circuit 34 processing the output signal of the thermal type flow sensor 32 may be of known structure and may have a structure as disclosed in, for example, U.S. Pat. No. 4,264,961.

Figure 4:
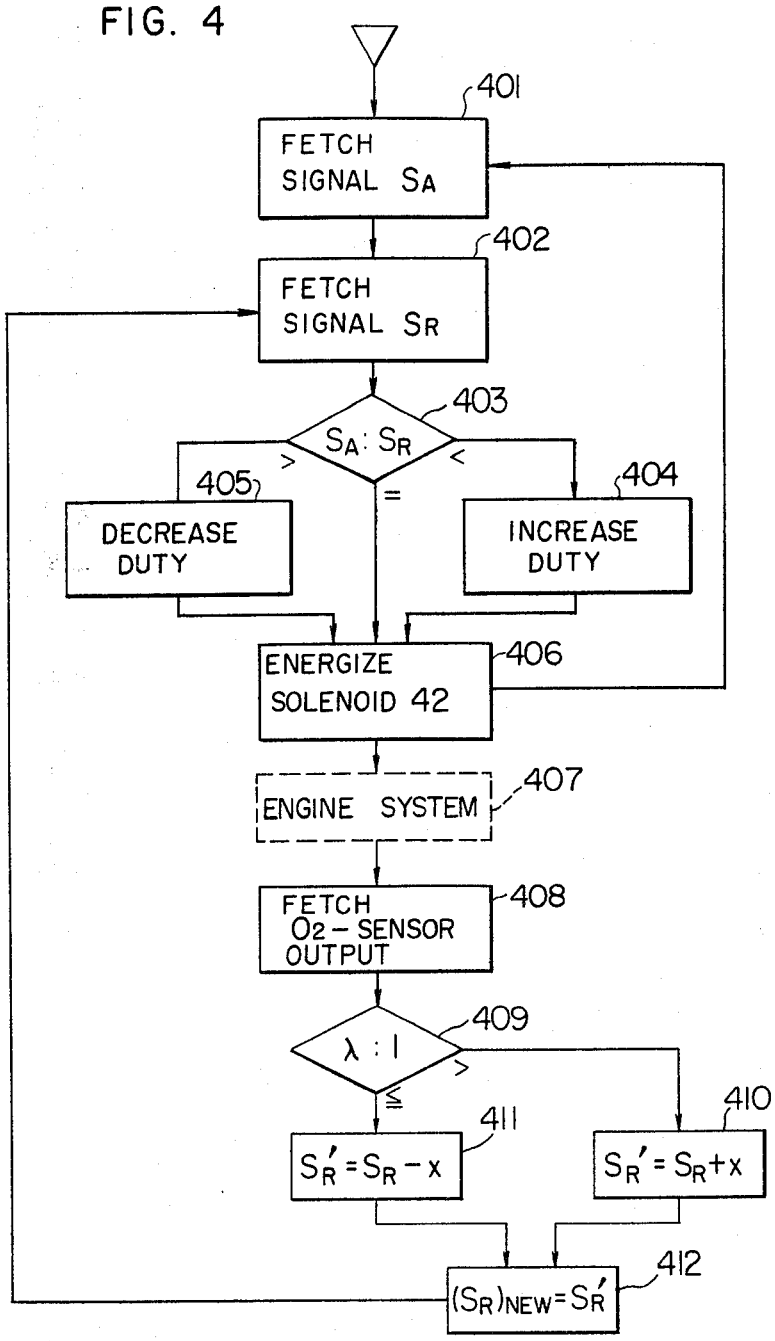
FIG. 4 is a flow chart illustrating the operation of the circuit shown in FIG. 3.
Figure 5:
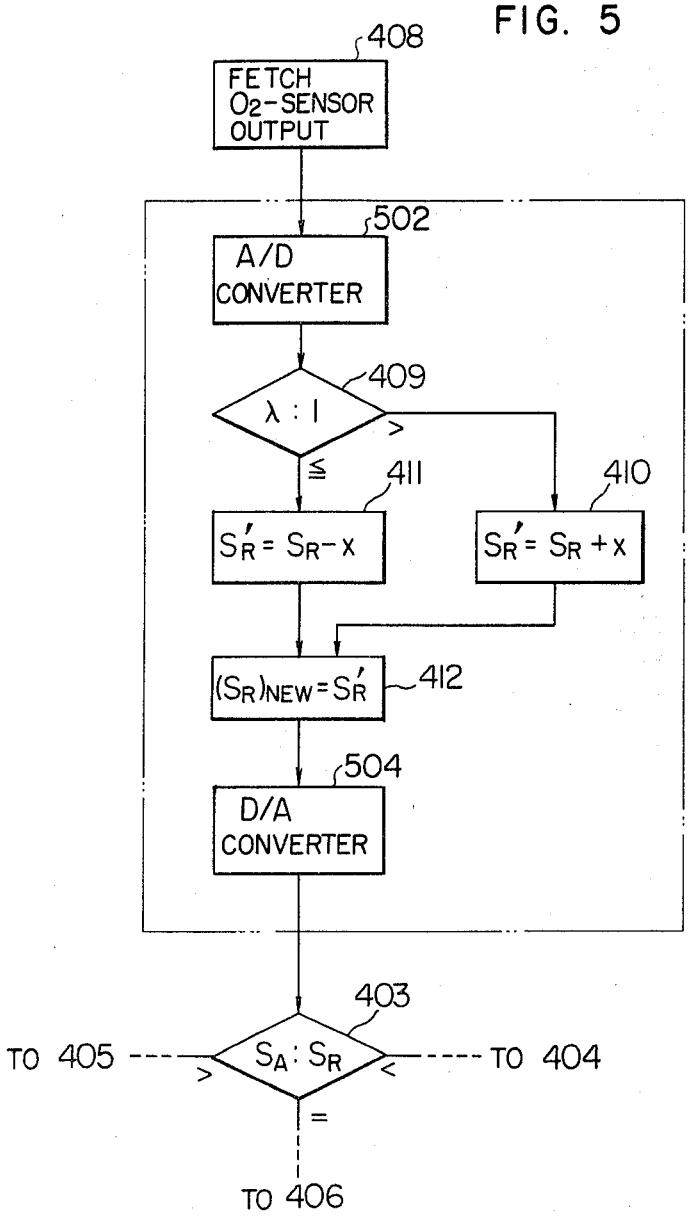
FIG. 5 is a flow chart in which digital processing is applied to part of the flow chart of FIG. 4.

FIG. 5 is a flow chart in which digital processing is applied to part of the flow chart of FIG. 4. That is, FIG. 5 illustrates that a microcomputer is used for the digital processing of part of the flow chart of FIG. 4. Therefore, the same reference numerals are used in FIG. 5 to designate steps equivalent to those appearing in FIG. 4.

Referring to FIG. 5, the output signal $S_o$ of the $O_2$ sensor 80 is converted in step 502 into a digital signal by an analog-digital converter (not shown), and processing similar to that described with reference to FIG. 4 is executed in steps

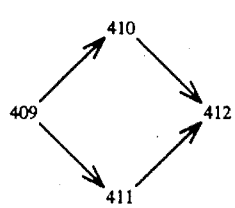

to obtain the modified signal $(S_R)_{NEW}$ in step 412. This signal $(S_R)_{NEW}$ is converted in step 504 into an analog signal by a digital-analog converter (not shown), and step 504 is followed by step 403.

For the purpose of comparison between $S_A$ and $S_R$ in step 403, an analog comparator is less expensive than a digital comparator. On the other hand, for the purpose of comparison between $S_o$ and $S_{\lambda=1}$ in step 409, a digital comparator is advantageous over an analog comparator in that comparison by the former is simpler than that by the latter.

It will be understood from the foregoing detailed description of the present invention that the air-fuel ratio is controlled to be maintained at the predetermined stoichiometric air-fuel ratio under closed-loop control CL1 maintaining constant the quantity of air flowing through the path of bypass air, and the rate $\lambda$ of excess air in engine exhaust gases is intermittently checked to suitably modify the setting under closed-loop control CL2 of variation of the air-fuel ratio in the course of the closed-loop control CL1. Therefore, engine exhaust gases can be sufficiently purified in all the operation ranges of the engine, and the engine can satisfactorily operate with the air-fuel ratio being always maintained at the stoichiometric air-fuel ratio.

We claim:

1. A fuel feeding apparatus for an internal combustion engine comprising;

(a) a main intake air path connected to an upstream side of a manifold portion of intake pipes;

(b) a Venturi portion formed in said main air-intake path;

(c) a throttle valve disposed in said main air-intake path at a position downstream of said Venturi portion;

(d) a bypass air path disposed adjacent to said main air-intake path to supply bypass air from a point upstream of said Venturi portion to said Venturi portion;

(e) an air flow meter disposed in said bypass air path to detect the quantity of air flowing through said bypass air path;

(f) an air-metering valve disposed in said bypass air path at a position downstream of said air flow meter;

(g) a fuel path feeding fuel continuously from a fuel pump into said main air-intake path during operation of the engine;

(h) a fuel-metering valve disposed in said fuel path;

(i) drive means for controlling the opening of said air-metering valve and said fuel-metering valve in such a manner that said fuel-metering valve is displaced to increase the quantity of fuel flowing through said fuel path when said air-metering valve is displaced to decrease the quantity of air flowing through said bypass air path;

(j) control signal generating means applying a control signal to said drive means for controlling the opening of said air-metering valve so that the output signal of said air flow meter attains coincidence with a pre-set level;

(k) an oxygen sensor disposed in an engine exhaust gas path; and (l) closed-loop control means for modifying the value of said pre-set level in response to the output signal of said oxygen sensor so that the rate of excess air in the engine exhaust gases can be maintained to be always equal to unity.

2. An apparatus as claimed in claim 1, wherein said fuel path supplies fuel into said main air-intake path at a point upstream of said throttle valve.

3. An apparatus as claimed in claim 1, wherein said drive means is an electromagnetic unit.

4. An apparatus as claimed in claim 3, wherein said air-metering valve, said fuel-metering valve and said electromagnetic unit are axially aligned on the same axis.

5. An apparatus as claimed in claim 4, wherein said air-metering valve and said fuel-metering valve have a tapered configuration, and the taper of said valves are so determined that the quantity of fuel metered by said fuel-metering valve increases when said air-metering valve is displaced to decrease the quantity of air metered thereby.

6. An apparatus as claimed in claim 3, wherein said air flow meter includes a thermal type flow sensor and an electrical circuit fetching and processing the output signal of said sensor.

7. An apparatus as claimed in claim 6, wherein the output signal of said thermal type flow sensor is compared in a comparator with the level pre-set by level setting means, and the resultant output signal of said comparator is applied to a duty pulse generating circuit connected to an output terminal of said comparator.

8. An apparatus as claimed in claim 6, wherein the output signal of said oxygen sensor is compared in a comparator with the output signal of a reference level setting circuit, and the resultant output signal of said comparator is applied to level setting means to modify said pre-set level.

9. An apparatus as claimed in claim 8, wherein said reference level setting circuit generates an output signal which indicates that the value of the rate of excess air in engine exhaust gases is unity.

10. An apparatus as claimed in claim 7, wherein the output signal of said thermal type flow sensor and the pre-set level of said level setting means are compared in said comparator in the form of analog values.

11. An apparatus as claimed in claim 8, wherein the output signal of said oxygen sensor and the output signal of said reference level setting circuit are compared in said comparator in the form of digital values.

* * * * *